United States Patent [19]

Tohma et al.

[11] 4,152,896

[45] May 8, 1979

[54] HYDRAULIC POWER SYSTEM WITH A LOAD-SENSING AND A CUTOFF CONTROL VALVE

[75] Inventors: Hideaki Tohma, Yokohama; Kazuo Uehara, Tokyo, both of Japan

[73] Assignee: Kabushika Kaisha Komatsu Seisakusho, Tokyo, Japan

[21] Appl. No.: 892,306

[22] Filed: Mar. 31, 1978

[30] Foreign Application Priority Data

Mar. 31, 1977 [JP] Japan ..... 52-38603[U]

[51] Int. Cl.[2] ..... F16H 39/46

[52] U.S. Cl. ..... 60/445; 60/452; 417/212

[58] Field of Search ..... 60/445, 448, 452; 417/212, 217

[56] References Cited

U.S. PATENT DOCUMENTS 2,713,772 7/1955 Horlacher ..... 60/452 X 3,830,594 8/1974 Hein et al. ..... 417/217

*Primary Examiner*—Edgar W. Geoghegan

*Attorney, Agent, or Firm*—Armstrong, Nikaido, Marmelstein & Kubovcik

[57] ABSTRACT

A control system for a variable displacement pump which powers a load actuator via a selector valve and which has its displacement varied by a pump actuator of the single-acting type. The system includes a load-sensing control valve for selectively communicating the pump actuator with a pressurized fluid source or with a fluid drain in accordance with a differential between the sum of the pump output pressure and the pump actuator pressure and the sum of the load actuator pressure and the force of a spring. Also included is a normally open, cutoff control valve, connected serially with the load-sensing control valve, for placing the pump actuator in communication with a fluid drain in response to the sum of the pump output pressure and pump actuator pressure acting against the force of a spring.

4 Claims, 6 Drawing Figures

HYDRAULIC POWER SYSTEM WITH A LOAD-SENSING AND A CUTOFF CONTROL VALVE

BACKGROUND OF THE INVENTION

1. Field of the Invention

This invention relates to hydraulic power systems, and in particular to a hydraulic control system for a variable displacement pump. Still more particularly, the invention pertains to such a control system including an improved load-sensing control valve and an improved cutoff control valve.

2. Description of the Prior Art

A variable displacement pump control system including a load-sensing and a cutoff control valve has been known (FIG. 1 of the accompanying drawings). A problem with this prior art system is that the control valves are of such construction and operation that the displacement of the pump may be varied all the way between 100 and 0 percent in response to slight changes in its output pressure. The result is the instability of the system operation.

SUMMARY OF THE INVENTION

It is therefore among the objects of this invention to stabilize the operation of the hydraulic power system of the type specified.

For the accomplishment of the above and other objects, the invention provides a hydraulic control system for a variable displacement pump powering a load actuator, which system comprises a pump actuator for adjusting the displacement of the pump, and a load-sensing control valve and a cutoff control valve connected serially between the pump actuator and a source of pressurized hydraulic fluid. The load-sensing control valve controls communication between pump actuator and pressurized fluid source in accordance with a differential between the sum of the pump output pressure and the pump actuator pressure and the sum of the load actuator pressure and the force of first resilient means. The cutoff control valve controls communication between pump actuator and pressurized fluid source in accordance with a differential between the force of second resilient means and the sum of the pump output pressure and the pump actuator pressure.

By the above summarized improvements, a change in pump displacement in response to a change in pump output pressure is made suitably less than by the prior art. The operation of the control system can thus be stabilized without substantially imparing its response.

The above and other objects, features and advantages of this invention and the manner of attaining them will become more readily apparent, and the invention itself will best be understood, from the following detailed description taken in connection with the accompanying drawings.

DETAILED DESCRIPTION

Figure 1:
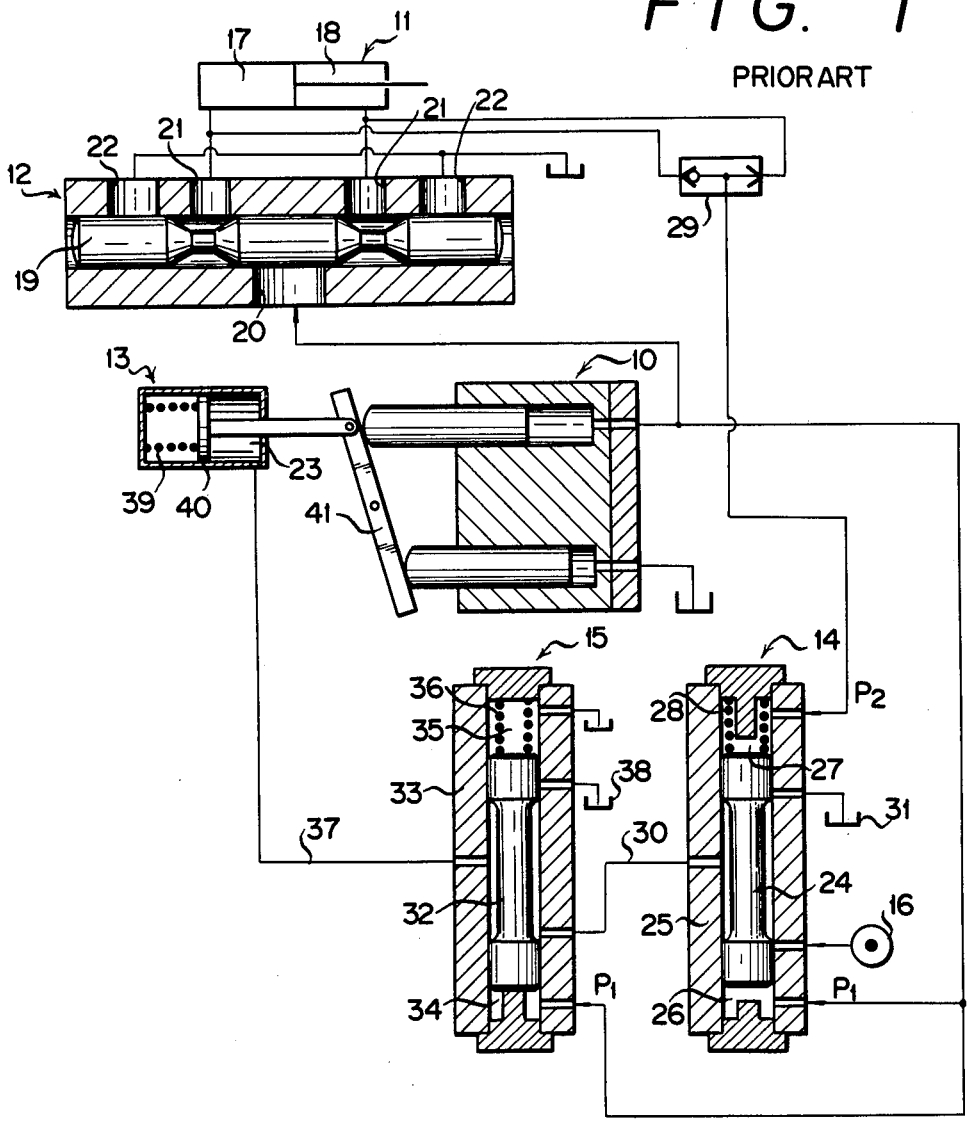
FIG. 1 PRIOR ART
FIG. 1 is a schematic representation, with parts in section, of a prior art hydraulic control system to be improved by this invention.

It will redound to the full appreciation of the features and advantages of this invention to show and describe, in some more detail, the prior art bearing particular pertinence to the invention. With reference therefore to FIG. 1, the illustrated prior art hydraulic control system broadly comprises a variable displacement pump 10 powering a load actuator 11 via a selector valve 12, a pump actuator 13 for adjusting the displacement of the pump 10, and a load-sensing control valve 14 and a cutoff control valve 15 which are connected serially between the pump actuator 13 and a source 16 of hydraulic fluid under pressure.

The load actuator 11 is shown to be of the double-acting type having a pair of opposed fluid chambers 17 and 18. Hydraulic fluid under pressure from the pump 10 is metered selectively into the fluid chambers 17 and 18 of the load actuator 11 by the selector valve 12. This selector valve includes a spool 19 capable of controlling communication between an inlet port 20 and a pair of outlet ports 21 and a pair of drain ports 22.

Of the single-acting, spring-return type, the pump actuator 13 has its fluid chamber 23 in selective communication with the pressurized fluid source 16 via the two control valves 14 and 15. The load-sensing control valve 14 includes a spool 24 slidably mounted within a housing 25 so as to define a pair of opposed fluid chambers 26 and 27 therein, with the fluid chamber 27 also accommodating a compression spring 28. The fluid chamber 26 is supplied with the output fluid pressure $P_1$ of the pump 10, whereas the other fluid chamber 27 is supplied with the pressure $P_2$ of the load actuator 11 via a shuttle valve 29. The spool 24 thus responds to the differential between the pump output pressure $P_1$ and the sum of the load actuator pressure $P_2$ and the force of the spring 28, for selectively communicating an output line 30 with the pressurized fluid source 16 or with a fluid drain 31.

The cutoff control valve 15 is of similar construction comprising a spool 32 slidably mounted within a housing 33 so as to define a fluid chamber 34 and a spring chamber 35 in opposed relationship to each other. The fluid chamber 34 is supplied with the output pressure $P_1$ of the pump 10, whereas the spring chamber 35 accommodates a compression spring 36. The spool 32 thus responds to the pump output pressure $P_1$, acting against the force of the spring 36, to selectively communicate an output line 37 leading to the pump actuator 13 with the input line 30 or with a fluid drain 38.

In the control system of the foregoing prior art configuration, the differential between the pump output pressure $P_1$ and the load actuator pressure $P_2$ increases to or in excess of a preset limit when the pump delivery rate is greater than a flow rate set by the selector valve 12. The result is a shifting of the load-sensing control valve spool 24 against the sum of the load actuator pressure $P_2$ and the force of the spring 28, with the consequent communication of the output line 30 with the fluid drain 31.

If the cutoff control valve 15 is now open, the fluid chamber 23 of the pump actuator 13 is placed in communication with the fluid drain 31. Therefore, under the bias of a compression spring 39, the piston 40 of the pump actuator 13 travels rightwardly, as viewed in FIG. 1, to actuate the swash plate 41 of the pump 10 in such a way that its delivery decreases, until the preset differential is regained between the pump output pressure $P_1$ and the load actuator pressure $P_2$.

In event the pump delivery is less than that set by the selector valve 12, on the other hand, the pump output pressure $P_1$ is overcome by the sum of the load actuator pressure $P_2$ and the force of the spring 28. The load-sensing control valve spool 24 is then shifted in a direction such that the pressurized fluid source 16 is placed in communication with the pump actuator chamber 23 via the cutoff control valve 15. Thereupon the pump actuator piston 40 travels leftwardly against the bias of the spring 39 thereby causing an increase in the delivery of the pump 10, to such an extent that the preset differential is again regained between the pump output pressure $P_1$ and the load actuator pressure $P_2$.

Figure 2:
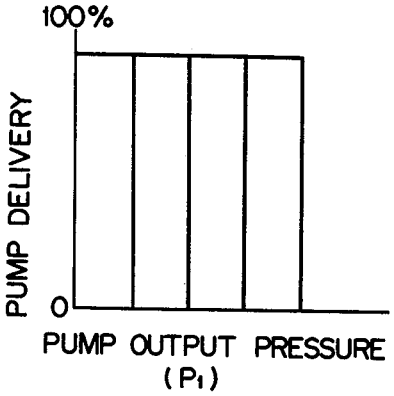
FIG. 2 is a graph showing the relationship between the delivery or output flow rate and output pressure of a variable displacement pump controlled in accordance with the prior art of FIG. 1.

It is thus seen that the load-sensing control valve 14 functions to maintain the differential between the pump output pressure $P_1$ and the load actuator pressure $P_2$ at the value determined by the spring 28. The displacement of the pump 10 can therefore be automatically adjusted to the flow rate which is set by the selector valve 12. The pump delivery and its pressure are determined by the flow rate setting of the selector valve 12 and by the pressure $P_2$ of the load actuator 11. FIG. 2 graphically represents the relationship between the pump delivery and the pump delivery pressure as controlled by the prior art system of FIG. 1.

The cutoff control valve 15 of the prior art control system functions to protect the system against overpressurization, in the following manner. In event the pump output pressure $P_1$ reaches a preset limit, the pressure in the cutoff control valve chamber 34 overcomes the force of the spring 36, shifting the spool 32 in a direction such that the output line 37 is blocked from communication with the input line 30 and is placed instead in communication with the drain 38. With the fluid in its chamber 23 thus drained, the pump actuator 13 functions to cause a decrease in the delivery of the pump 10, until the pump delivery equals the setting by the selector valve 12. It is therefore evident that the pump output pressure is never to exceed the limit determined by the cutoff control valve spring 36.

Figure 3:
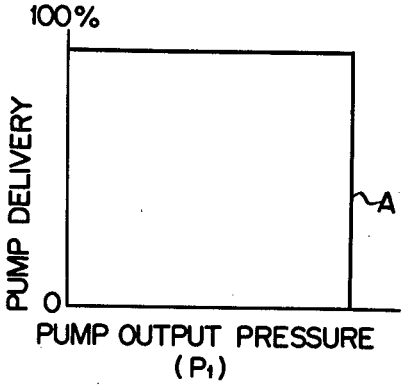
FIG. 3 is a similar graph showing the relationship between pump delivery and pump output pressure according to the prior art.

FIG. 3 is a graphic representation of the relationship between the pump delivery and the pump delivery pressure as controlled by the prior art cutoff control valve 15. The pump delivery makes a sharp decrease at the cutoff pressure, as indicated at A in FIG. 3.

As will be apparent from the foregoing, the problem with the prior art is that, as the system is rendered highly responsive, the pump delivery may make a complete change between 100 and 0% in response to a minute change in the pump output pressure. Such undesiredly great variations of pump delivery invite unstable operation of the load-sensing power system. It is to a solution of this problem that the present invention is directed.

Figure 4:
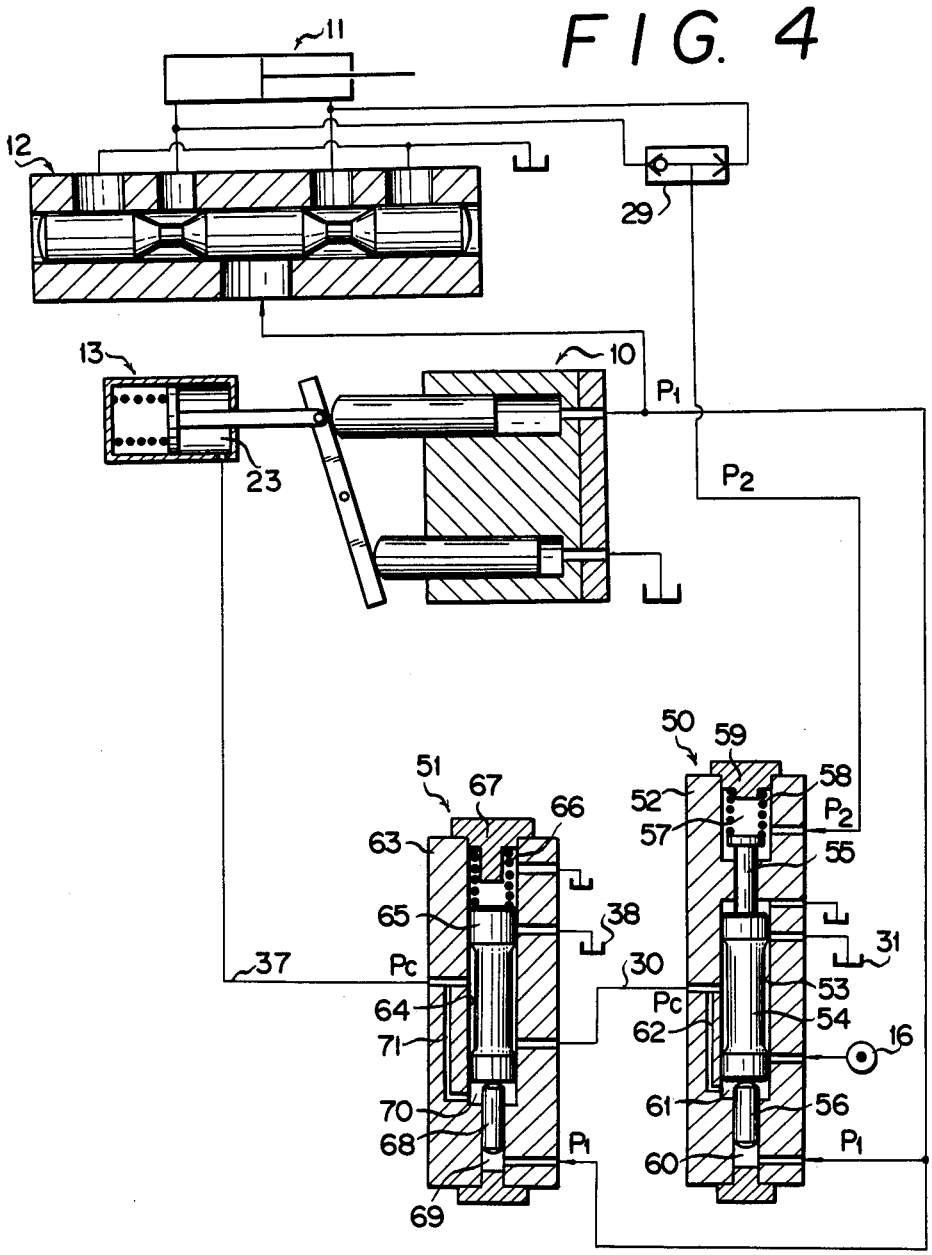
FIG. 4 is a schematic representation, with parts in section, of the hydraulic control system embodying the improvements of this invention.

FIG. 4 illustrates the improved hydraulic control or power system embodying the principles of the invention. The inventive improvements of the system resides in a load-sensing control valve 50 and in a cutoff control valve 51. The other parts or components of the system can be constructed and arranged as in the prior art system of FIG. 1, so that such conventional parts or components are identified in FIG. 4 by the same reference numerals as those used to denote the corresponding parts of the prior art system, and their description will be omitted.

The improved load-sensing control valve 50 includes a housing or body 52 having formed therein a bore 53 for slidably receiving a spool 54. This spool 54 is slidable between a first position (bottom position in FIG. 4) for communicating the pump actuator chamber 23 with the pressurized fluid source 16 and a second position (top position) for communicating the pump actuator chamber with the fluid drain 31, through a closed center position in which the spool is shown to be located. Also slidably mounted within the valve housing 52 are first and second pistons 55 and 56 which are arranged in axial alignment with, and in end-to-end abutment against, the spool 54.

Of the two pistons of the load-sensing control valve 50, the first piston 55 projects into a fluid chamber 57 which is in constant communication with the outlet of the shuttle valve 29 and which accommodates a compression spring 58 extending between the first piston and an end cover 59 of the valve housing 52. The first piston 55 thus functions to urge the spool 54 toward the first position in response to the load actuator pressure $P_2$ acting in the same direction as the spring 58.

The second piston 56 extends into a fluid chamber 60 which is in constant communication with the outlet of the variable displacement pump 10 under control. A further fluid chamber 61 is defined by the valve housing 52 and that end of the spool 54 against which the second piston 56 abuts. This chamber 61 is in constant communication with the output line 30 by way of a passage 62. The spool 54 is therefore to be urged toward the second position by the resultant of the pump output pressure $P_1$ acting effectively on the second piston 56 and the output line pressure $P_c$ acting effectively on the the spool.

The improved cutoff control valve 51 likewise includes a housing or body 63 having formed therein a bore 64 slidably receiving a spool 65. This spool is slidable between a first or normal position for communicating the pump actuator chamber 23 with the pressurized fluid source 16 via the load-sensing control valve 50 and a second position for communicating the pump actuator chamber with the fluid drain 38. A compression spring 66, extending between a housing end cover 67 and the spool 65, biases the latter toward the first position.

Also slidably mounted within the cutoff control valve housing 63 is a piston 68 which is in alignment with, and in end-to-end abutment against, the spool 65. This piston extends into a fluid chamber 69 which is in constant communication with the outlet of the pump 10. Another fluid chamber 70 is defined by the valve housing 63 and that end of the spool 65 against which the piston 68 abuts. This chamber 70 is in constant communication with the output line 37 by way of a passage 71. The spool 65 is therefore to be shifted from the first toward the second position in response to the resultant, acting against the bias of the spring 66, of the pump output pressure $P_1$ acting effectively on the piston 68 and the output line pressure $P_c$ acting effectively on the spool.

OPERATION

In the improved load-sensing control valve 50 of the foregoing construction, the spool 54 is dynamically balanced in accordance with the equation:

$$F + \frac{\pi}{4} d_1^2 P_2 = \frac{\pi}{4} d_3^2 P_1 + \frac{\pi}{4} (d_2^2 - d_3^2) P_c \quad (1)$$

where F is the preset force of the compression spring 58; $d_1$ the effective diameter of the first piston 55; $d_2$ the effective diameter of the spool 54; and $d_3$ the effective diameter of the second piston 56.

Considering the case where the load actuator pressure $P_2$ has a certain fixed value, the left side of Equation (1) can be considered to have a constant value, so that this equation can be rewritten as:

$$\frac{\pi}{4} d_3^2 P_1 + \frac{\pi}{4} (d_2^2 - d_3^2) P_c = C_1 \quad (2)$$

where $C_1$ is a constant. If $$\frac{\pi}{4} d_3^2 = k_1 \text{ and } \frac{\pi}{4} (d_2^2 - d_3^2) = k_2,$$

then Equation (2) can be rewritten as:

$$k_1 P_1 + k_2 P_C = C_1 \quad (3)$$

If $$\frac{k_2}{k_1} = k_3 \text{ and } \frac{C_1}{k_1} = C_2,$$

then Equation (3) can further be rewritten as:

$$P_1 + k_3 P_c = C_2 \quad (4)$$

Since the passage 62 in the load-sensing control valve housing 52 is in communication with the pump actuator chamber 23 via the cutoff control valve 51, the pump delivery is at a maximum, and the pump output pressure $P_1$ at a minimum, at the maximum $P_c$ value. At the minimum $P_c$ value, on the other hand, the pump delivery is at a minimum, and the pump output pressure at a maximum.

Figure 5:
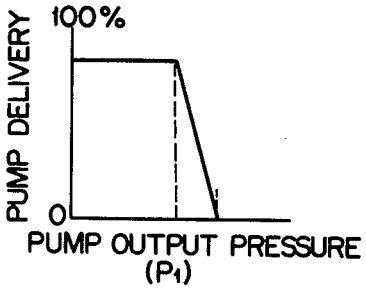
FIG. 5 is a graph showing the relationship between the delivery and output pressure of a variable displacement pump controlled in accordance with the invention.
Figure 6:
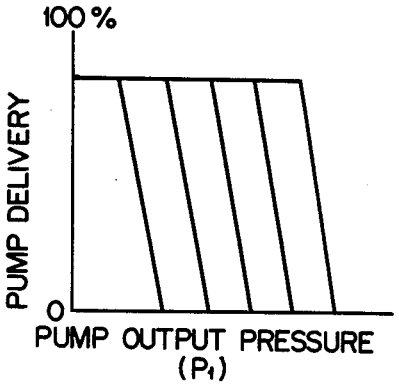
FIG. 6 is a similar graph showing the relationship between pump delivery and pump output pressure according to the invention.

From the foregoing considerations, it will be seen that the relationship between the pump delivery and the pump output pressure $P_1$ is as graphically represented in FIG. 5. With the load actuator pressure $P_2$ assumed to be constant, a change in the pump delivery results in a comparatively slight change in the pump output pressure $P_1$. This relationship is unchanged even when the load actuator pressure $P_2$ varies, and also holds true with the cutoff control valve 51. The relationship between the pump delivery and the pump output pressure $P_1$ is therefore as graphically represented in FIG. 6.

As mentioned, the spool 54 of the improved load-sensing control valve 50 is shifted in accordance with the differential between the sum of the pump output pressure $P_1$ and the pump actuator pressure $P_c$ and the sum of the load actuator pressure $P_2$ and the force of the spring 58. The spool 65 of the improved cutoff control valve 51 is shifted in accordance with the differential between the force of the spring 66 and the sum of the pump output pressure $P_1$ and the pump actuator pressure $P_c$.

Thus, in event the spools 54 and 65 of the load-sensing and the cutoff control valves 50 and 51 are both shifted to the second positions in response to an increase in the pump output pressure $P_1$, for example, the pump actuator 13 has its fluid chamber 23 placed in communication with the drain and thus functions to decrease the delivery of the pump 10. Since then the fluid chambers 61 and 70 of the load-sensing and the cutoff control valves 50 and 51 are also placed in communication with the fluid drain, the change in the pump delivery in response to the change in the pump output pressure is less according to this invention than in the prior art. The operation of the hydraulic power system is thus effectively stabilized without substantially sacrificing its response.

It is to be understood that the foregoing description of the preferred embodiment is meant purely to illustrate or explain and not to impose limitations upon the invention. The scope of the invention is to be determined only by the terms of the following claims.

What is claimed is:

1. A hydraulic control system for a variable displacement hydraulic pump powering a load actuator, comprising in combination:

a pump actuator for adjusting the displacement of the pump;

a source of hydraulic fluid under pressure for powering the pump actuator;

a load-sensing control valve including first resilient means and adapted to control communication between the pump actuator and the source in accordance with a differential between the sum of the output pressure of the pump and the pressure of the pump actuator and the sum of the pressure of the load actuator and the force of the first resilient means; and a cutoff control valve connected serially with the load-sensing control valve and including second resilient means, the cutoff control valve being adapted to control communication between the pump actuator and the source in accordance with a differential between the force of the second resilient means and the sum of the output pressure of the pump and the pressure of the pump actuator.

2. The hydraulic control system as recited in claim 1, wherein the load-sensing control valve comprises:

a housing having a bore formed therein;

a spool slidably fitted in the bore for movement between a first position for communicating the pump actuator with the source and a second position for communicating the pump actuator with a fluid drain, through a closed center position, the spool being biased toward the first position by the first resilient means;

means for causing the pressure of the load actuator to urge the spool toward the first position in cooperation with the force of the first resilient means;

means for causing the pressure of the pump actuator to act effectively on one end of the spool to urge same toward the second position;

a piston slidably mounted within the housing in alignment with the spool and having one end arranged for abutment against said one end of the spool; and means for causing the output pressure of the pump to act effectively on the other end of the piston and hence to cause same to urge the spool toward the second position.

3. The hydraulic control system as recited in claim 1, wherein the cutoff control valve comprises:

a housing having a bore formed therein;

a spool slidably fitted in the bore for movement between a first position for communicating the pump actuator with the source and a second position for communicating the pump actuator with a fluid drain, the spool being biased toward the first position by the second resilient means;

means for causing the pressure of the pump actuator to act effectively on one end of the spool to urge same toward the second position;

a piston slidably mounted within the housing in alignment with the spool and having one end arranged for abutment against said one end of the spool; and means for causing the output pressure of the pump to act effectively on the other end of the piston and hence to cause same to urge the spool toward the second position.

4. A hydraulic power system of the type which includes a variable displacement pump powering a load actuator, comprising in combination:

a single-acting pump actuator for adjusting the displacement of the pump;

a source of hydraulic fluid under pressure;

a load-sensing control valve including first resilient means and adapted to selectively communicate the pump actuator with the source or with a fluid drain in accordance with a differential between the sum of the output pressure of the pump and the pressure of the pump actuator and the sum of the pressure of the load actuator and the force of the first resilient means; and a cutoff control valve connected serially with the load sensing control valve and including second resilient means, the cutoff control valve being adapted to normally provide open communication therethrough and to place the pump actuator in communication with a fluid drain when the force of the second resilient means is overcome by the sum of the output pressure of the pump and the pressure of the pump actuator.

* * * * *